US009245432B2

(12) United States Patent
Yang

(10) Patent No.: US 9,245,432 B2
(45) Date of Patent: Jan. 26, 2016

(54) EAS TAG UTILIZING MAGNETOMETER

(71) Applicant: Xiao Hui Yang, Saratoga, CA (US)

(72) Inventor: Xiao Hui Yang, Saratoga, CA (US)

( * ) Notice: Subject to any disclaimer, the term of this patent is extended or adjusted under 35 U.S.C. 154(b) by 0 days.

(21) Appl. No.: 14/461,326

(22) Filed: Aug. 15, 2014

(65) Prior Publication Data

US 2015/0048947 A1 Feb. 19, 2015

Related U.S. Application Data

(60) Provisional application No. 61/866,361, filed on Aug. 15, 2013.

(51) Int. Cl.
*G08B 13/14* (2006.01)
*G08B 13/24* (2006.01)

(52) U.S. Cl.
CPC ..... *G08B 13/248* (2013.01); *G08B 13/2434* (2013.01)

(58) Field of Classification Search
CPC ..... G08B 13/2402; G08B 13/1409; E05B 73/0017; H01F 1/00
USPC ..... 340/572.8, 572.1–572.7, 10.1, 13.26; 324/244
See application file for complete search history.

(56) References Cited

U.S. PATENT DOCUMENTS

| | | | | |
|---|---|---|---|---|
| 3,781,664 | A | 12/1973 | Rorden | |
| 4,063,230 | A | 12/1977 | Purington et al. | |
| 4,635,207 | A | 1/1987 | Payne | |
| 4,992,776 | A | 2/1991 | Crossfield | |
| 6,882,275 | B2 | 4/2005 | Blanpain et al. | |
| 2010/0001872 | A1* | 1/2010 | Lian et al. | 340/661 |
| 2011/0109455 | A1* | 5/2011 | Bergman et al. | 340/568.5 |
| 2011/0304458 | A1* | 12/2011 | Sayegh et al. | 340/568.8 |
| 2012/0092166 | A1* | 4/2012 | Allen et al. | 340/572.1 |
| 2014/0184412 | A1* | 7/2014 | Boudet et al. | 340/568.1 |

* cited by examiner

*Primary Examiner* — Phung Nguyen
(74) *Attorney, Agent, or Firm* — Waters Law Group, PLLC; Brian W. Foxworthy; Robert R. Waters

(57) ABSTRACT

An EAS tag comprises a microprocessor, motion sensor, magnetometer, communication elements, and audible alarm generator. Various means of attaching the tag to an object to be protected can be used. The magnetometer can measure the magnetic fields around it and digitally transmit the information to the microprocessor for storage. After a certain period of inactivity as measured by the motion sensor, the tag enters a state of reduced activity to conserve energy. When the motion sensor determines that the tag is being moved, the magnetometer takes a current snapshot which is compared to a previous snapshot. If the two images differ over certain percentage, the tag alarms. The tag can also monitor the ambient magnetic fields in real time and, when the fields change abruptly, the tag alarms. This prevents defeating the tag by placing it in a metallic foil bag.

20 Claims, 5 Drawing Sheets

EAS TAG UTILIZING MAGNETOMETER

CROSS REFERENCE TO RELATED APPLICATIONS

This application claims priority to U.S. Provisional Application 61/866,361 filed on Aug. 15, 2013. The entirety of U.S. Provisional Application 61/866,361 including both the figures and specification are incorporated herein by reference.

FIELD OF INVENTION

The present application is generally related to asset protection. More specifically, the present application is related to countering the theft technique of placing items that are being protected by an EAS tag in a foil bag which defeats the EAS tag's capabilities.

RELATED ART

U.S. Pat. No. 6,882,275 by Blanpain is for a microsystem using magnetometer and inclinometer for anti-theft protection of valuables. A device for the detection of movement of a valuable object, for example in a museum in which a device for detecting at least a rotation of the object, and particularly magnetometers or inclinometers, are mechanically fixed to the object. These detecting devices are coupled to a message transmission device that sends a presence message as long as detection has not taken place and an alert type message when detection has taken place. A monitoring station processes these messages or the absence of these messages, to trigger an alert if necessary.

U.S. Pat. No. 3,781,664 by Rorden for magnetic detection for an anti-shoplifting system utilizing combined magnetometer and gradiometer signals. In Rorden, a magnetic surveillance system useful for detecting unauthorized removal of magnetically marked objects through a surveillance region includes at least one and preferably two three axis fluxgate type magnetometer-gradiometer sensors proximate the region to be monitored such as at an exit. Both the magnetometer and gradiometer signals are processed by appropriate algorithms to derive outputs proportional to the magnetic moment of and range to a magnetic anomaly within the region under surveillance. Minimum and maximum threshold values are prescribed for the detected magnetic moment to provide a window encompassing the magnetic moment of the marker to be detected while excluding other magnetic moments which could lead to a false alarm. A range threshold is set to exclude indication of magnetic moments outside of the region under surveillance.

SUMMARY OF EMBODIMENTS OF THE INVENTION

Embodiments of the present invention are for anti-theft electronic article surveillance (EAS) systems and tags. The tags have the ability to generate an alarm signal under conditions indicating theft. One of the techniques for defeating many types of EAS tags is to place the tags, and sometimes the object to which they are attached, into metallic foil bags. The metallic foil bags prevent the tags from interacting with the broader EAS systems which allows the tags to be stolen. The tags cannot receive or send signals with the broader system. For systems employing passive EAS elements in tags and interrogation fields at exits, the passive element in the tag cannot be stimulated by the interrogation field and therefore no detectable signal is generated for the system to detect. For systems with more complex communications between the EAS tag and the broader EAS system, these communications are prevented by the metallic foil bag. Embodiments of the tags of the present application defeat this theft technique. Also, this method of theft prevention facilitates a long battery life for the batteries powering the tags.

The tags comprise: a microprocessor; a motion sensor; a magnetometer; wireless communication elements such as a radio frequency (RF) transmitter and receiver, or RF transceiver or an infrared communication port; an audible alarm generator; a battery powering the foregoing elements; an attaching mechanism for releaseably attaching the tag to an object that is to be protected, and sometimes a locking device associated with the attaching mechanism; and some embodiments may include a passive EAS element. One type of EAS system uses acousto-magnetic (AM) passive elements which function at approximately 58 kHz frequency within the radio frequency range. As this type of EAS system generates its interrogation fields at 58 kHz, it may employ the same frequency for wireless communication between the system and the tags.

The electronic components powered by the battery perform several logic and communication functions. The microprocessor is capable of storing and executing programmed instructions. The motion sensor functions to determine when the tag is being moved. The motion sensor may actually detect motion, or the motion sensor may monitor the orientation of the tag, for example, by sensing gravity, and interpret a change in orientation of the tag as motion.

The magnetometer is capable of sensing the local magnetic field of the earth as well as fields generated locally by electronic equipment and field generators. The magnetometer is capable of establishing a snapshot of the ambient fields around it. This snapshot of the fields around the magnetometer can be transmitted from the magnetometer to an external device, such as the microprocessor in the current application, for retention and storage. Once the magnetometer has established a magnetic field snapshot of its surroundings and it has been stored, it can be compared to later readings as part of an anti-theft scheme.

When a tag is applied to an object and armed, the magnetometer captures a snap shot of surrounding fields and it is stored in memory. After a period of immobility as measured by the motion sensor, the electronics of the tag interpret the immobility to mean the tag and its respective object have been laid down and the activity of the electronics of the tag are cut back to a minimum. The electronics of the tags are normally idle, except for the motion sensor and the limited requirements on the microprocessor to monitor the motion sensor.

When the motion sensor indicates that the tag is in motion, the rest of the electronics begin to have roles. The magnetometer performs a measurement of the fields in its surroundings and transmits its measurements to the microprocessor which compares it to a previous snap shot. Depending on the results of the comparison, the microprocessor may determine that an alarm condition exists and generate an alarm. For example, if the magnetometer transmits a snapshot to the microprocessor that varies from the previously stored snapshot by a percentage over a preset threshold, the tag may sound an audible alarm along and generate other alarm signals. In other cases, the tag may use the magnetometer to do real time filed monitoring while the tag is in motion. A sudden curtailment in field readings could be interpreted to mean that the EAS tag has been placed in a foil bag, and the alarming functions of the tag could then be activated.

In some embodiments, radio frequency communication circuitry may also be used sense, or monitor, the tag's environment. When the tags are activated by motion sensor detecting motion, the radio frequency receivers, or transceivers, monitor for radio frequency signals, or fields, that they expect to detect. If the expected fields, or signals, are not detected by the radio frequency receivers, the tags will self alarm and produce an alarm. In some embodiments, this alarm may be an audible alarm to notify surrounding persons. In other embodiments, the alarm may be a radio signal alarm detectable by other elements of the system. If the expected signal fields are detected by the radio frequency receivers, then the input received by the tag is considered normal, and the tags will simply continue to monitor for the signal fields for a predetermined time after the tags come to rest. In AM (acousto-magnetic) systems the fields and communication occurs around the acousto-magnetic frequency (AMF) of 58 KHz frequency of the system.

Once the tags are at rest for the predetermined period, the tags will go idle again, except for the motion sensor and monitoring microprocessor. Receivers can be placed at locations where tag alarm signals are anticipated so that tag signals need not be overly powerful and drain the onboard battery. The infrequent broadcast by the tags reduces drain on the power source and greatly extends the life of a tag.

The operation of the tags described above function in cooperation with a larger EAS system. Assets that are to be monitored have tags releasably attached to them and are located in a given area protected by the EAS system. The larger EAS system may supply a component of the ambient fields sensed by the magnetometer. Other equipment in proximity to a given tag may also incidentally generate fields that end up contributing to the snapshot taken by the magnetometer.

In some applications, the system may generally saturate the protected area with a radio frequency signal. Also, the RF (or AMF) signal may have a code modulated onto the signal. When objects with the above described tags are moved within a protected area, the motion transmitted to the associated tag is detected by the motion sensor being monitored by the microprocessor. The microprocessor and transceiver circuitry then begin to monitor for the signal. This provides a redundant check to the magnetometer in embodiments employing both a RF (AMF) transceiver monitoring for field transmission and a magnetometer monitoring local magnetic fields.

Once an alarm condition is determined, the alarm may continue to sound until the tag is instructed to cease alarming by the system. This may be by returning the object and its accompanying tag to the protected area where the signal is obtainable, or by more specific instructions from the system via RF (or AMF) communications. In some embodiments, the tags may continue to alarm even after being returned to the protected area and may require specific instructions from the system to cease alarming.

In some EAS systems, multiple discrete signal radiating units comprising signal radiating elements such as signal generating circuits, and antennas may be used to monitor a protected area. The signal radiating units can be mounted overhead with their signal directed downward. This positions the signal radiating units out of the way, and allows the fields of their signals to expand downward toward the occupied space of a protected area, where the majority of objects and tags are located. The operating areas of these units may overlap slightly. In these systems, the signal radiating units can be placed closer to the area where the tags are which reduces the distance of which the tags must transmit a signal. This reduces power requirements for the tags which enables longer battery life. The radiating units may also be located at ground level when preferred.

The radiating units have external power sources ultimately based on the ubiquitous alternating current system and therefore are not limited in their power capabilities as the tags are. In at least one embodiment, the radiating units use a characteristic of the mains power system to synchronize their transmission of signals. A typical characteristic that is used is a zero crossing of a phase of the mains power supply alternating current. In at least one embodiment, the signal radiating units have power transformers to convert the available power to a different voltage required for the electronics of the signal radiating units. Also, where it is possible to use a single antenna to cover the entire protected area, the system would work with a single antenna to generate the signal field as well.

The use of several radiating units allows the signal field of the protected area to be closely tailored to the physical contours of the protected area. Additionally, some radiating units may transmit a canceling, or interference, field to attenuate the signal in particular areas. For example, radiating units nearest exits from the protected area may transmit a canceling field so that the signal is attenuated at the exits but within the physical space of the protected area. In application in a retail environment, this would mean that a tag on an object being improperly removed from the retail store would fail to detect the system field while still in the store. This may trigger an alarm condition for the tag, causing the tag to generate an audible alarm.

Embodiments of tags may vary widely in how they releasably attach to the objects they are protecting. The various attaching mechanism available to attach a tag to a protected object include: tack and clutch mechanisms; lanyards; pivoting members clamping around the object, and; adhesive elements. Some embodiments of tags will have tamper detection capabilities which will vary depending on how the tag attaches to an object. For example, lanyard tags may employ a lanyard with a conductive element, so that when a lanyard is cut to remove a tag, an electrical conductive circuit is changed, indicating tampering. Other tags may employ switches to indicate when parts of a tag are being separated without authorization or without the tag being disarmed.

Some embodiments of the tags may carry a passive EAS element. These passive EAS elements work with EAS systems that generate interrogation fields at exits or other areas of interest. There are at least two types of passive EAS elements.

One type of passive element comprises a wire coil and ferrite core. While transmitting, the interrogation field builds up energy in the coil and core element. When the interrogation field ceases, the energy in coil and core elements dissipates and generates a signal that is a harmonic of the interrogation field. The EAS system monitors for these harmonics, and when a harmonic signal is detected, the system determines that a tag is present in the monitored area and an alarm condition is determined.

Another type of passive tag uses two small metal strips. One has a magnetic bias to it, while the other does not. The two strips are arranged in proximity to each other with only limited constraints and together are tuned to resonate when brought into an interrogation field. The resonance produces a signal which the EAS system can detect. Detection of the signal produces an alarm condition in the EAS system. These passive tags are acousto-magnetic tags and systems using them operate at the AMF of 58 kHz.

BRIEF DESCRIPTION OF DRAWINGS

Additional utility and features of the invention will become more fully apparent to those skilled in the art by reference to the following drawings, which illustrate some of the primary features of preferred embodiments.

DETAILED DESCRIPTION OF EMBODIMENTS OF THE INVENTION

Figure 1:
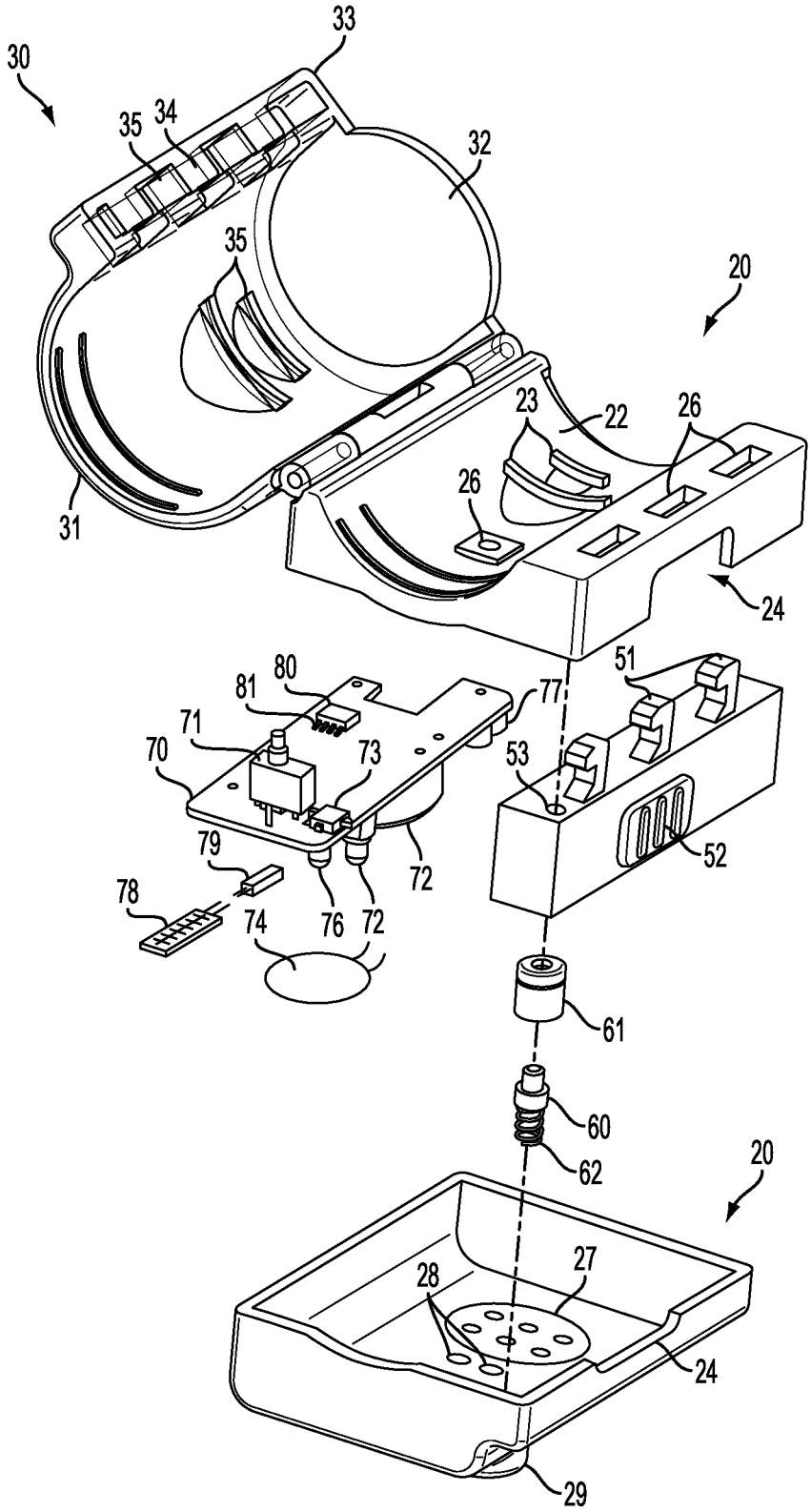
FIG. 1 is an exploded perspective view of an embodiment of an asset protection tag showing internal elements of the tag. The tag is hinged and attaches by closing around an object to be protected.

FIG. 1 is an exploded perspective view of an embodiment of an asset protection tag 10 for bottles showing internal elements of the tag. The bottle may be a wine bottle or other bottle having a bottle neck and an annular feature around its neck. Tag 10 in FIG. 1 is comprised of a first component 20 and a second component 30 hinged together. First component 20 and second component 30 can move between a myriad of open positions and a closed position. When in the closed position, tag 10 forms a cavity or passageway for fitting around the neck of a bottle.

In FIG. 1, first component 20 is separated into two pieces, exposing the compartment inside of housing 21, and the elements of tag 10 contained in housing 21. First component 20 has several apertures from some of these internal elements extend. Switch aperture 26 in concave surface 22 of first component 20 allows arming switch 71 to extend from internal of first component out into the passageway where a bottle fits. Hook apertures 26 allow hooks 51 of latch 50 to pass through the wall of first component 20, while latch button aperture 24 exposes latch button 52 on latch 50. In the embodiment of tag 10 of FIG. 9, latch button aperture 24 is formed by both pieces of first component 20. Pockets 35 in second component 30 receive hooks 51 when tag 10 is in the closed position and tabs 34 are engaged by hooks 51 when latch 50 is slid to latch the two components into the closed position.

As part of a locking mechanism, latch 50 also has a lock aperture 53 at one end. Blocking pin 60, cup 61, and spring 62 complete the locking mechanism. Blocking pin 60 and spring 62 seat in dome 29 of first component 20. Cup 61 seats over blocking pin 60 and spring 62 and maintains blocking pin 60 in position in dome 29. Spring 62 biases blocking pin 60 upward. When latch 50 is slid to engage hooks 51 with tabs 34 of latch receiver 33, spring 62 pushes blocking pin 60 up into lock aperture 53. Blocking pin 60 then blocks movement of latch 50 and keeps it engaged with latch receiver 33. Blocking pin 60 and latch 50 are releasable. Blocking pin 60 is at least partially comprised of a magnetically attractable material. Application of a magnet to dome 29, draws blocking pin 60 down against spring 62, into dome 29, and out of lock aperture 53 in latch 50. With blocking pin 60 withdrawn, latch 50 can be disengaged from latch receiver 33. When latch 50 is in the disengaged position, latch 50 keeps pin 60 recessed in cup 61.

Along with latch 50 and the associated blocking mechanism, housing 21 contains an electronics package. Among the electronic elements that may be contained in housing 21 are: circuit board 70; arming switch 71; microprocessor 72; latch switch 73; audible alarm generator 74; infrared communication port 75; light emitting diode 76; battery 77; radio frequency circuitry 78; motion detection chip 79; and magnetometer 80. A passive EAS element, such as a passive core and coil EAS element or a passive acousto-magnetic EAS element, may also be present in the electronics package.

When tag 10 is assembled, arming switch 71 protrudes through switch aperture 26 in concave surface 22 of first component 20. When tag 10 is in the closed position, arming switch 71 extends out into the cavity or passageway formed by first and second components 20 and 30. If a bottle is present, it changes the state of arming switch 71. The change in the state of arming switch 71 indicates that first component 20 and second component 30 are rotated into a closed position and a bottle is in place. This is detected by circuit board 70 and microprocessor 72. Anti-theft tag 10 may then be armed. The arming of anti-theft tag 10 may be automatic or it may be completed by communication from an external device. In embodiments having latch switch 73, the movement of latch 50 to the engagement position will change the state of latch switch 73. This change in state of latch switch 73 in combination with the prior change in state of arming switch 71 can combine to arm anti-theft tag 10. Other embodiments of anti-theft tag 10 may be armed by communication from an external device.

Figure 2:
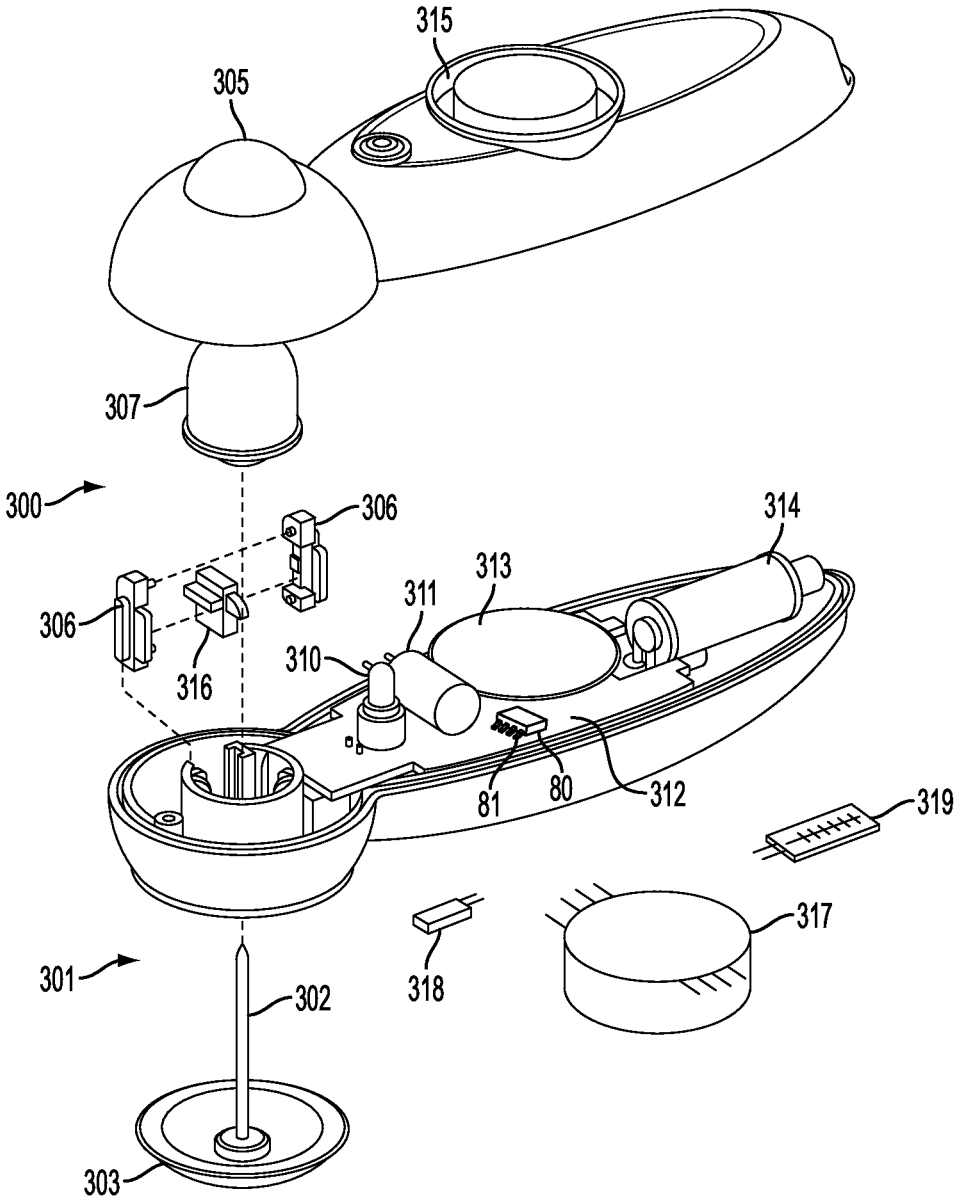
FIG. 2 is an exploded perspective view of a tack attached tag.
Figure 3:
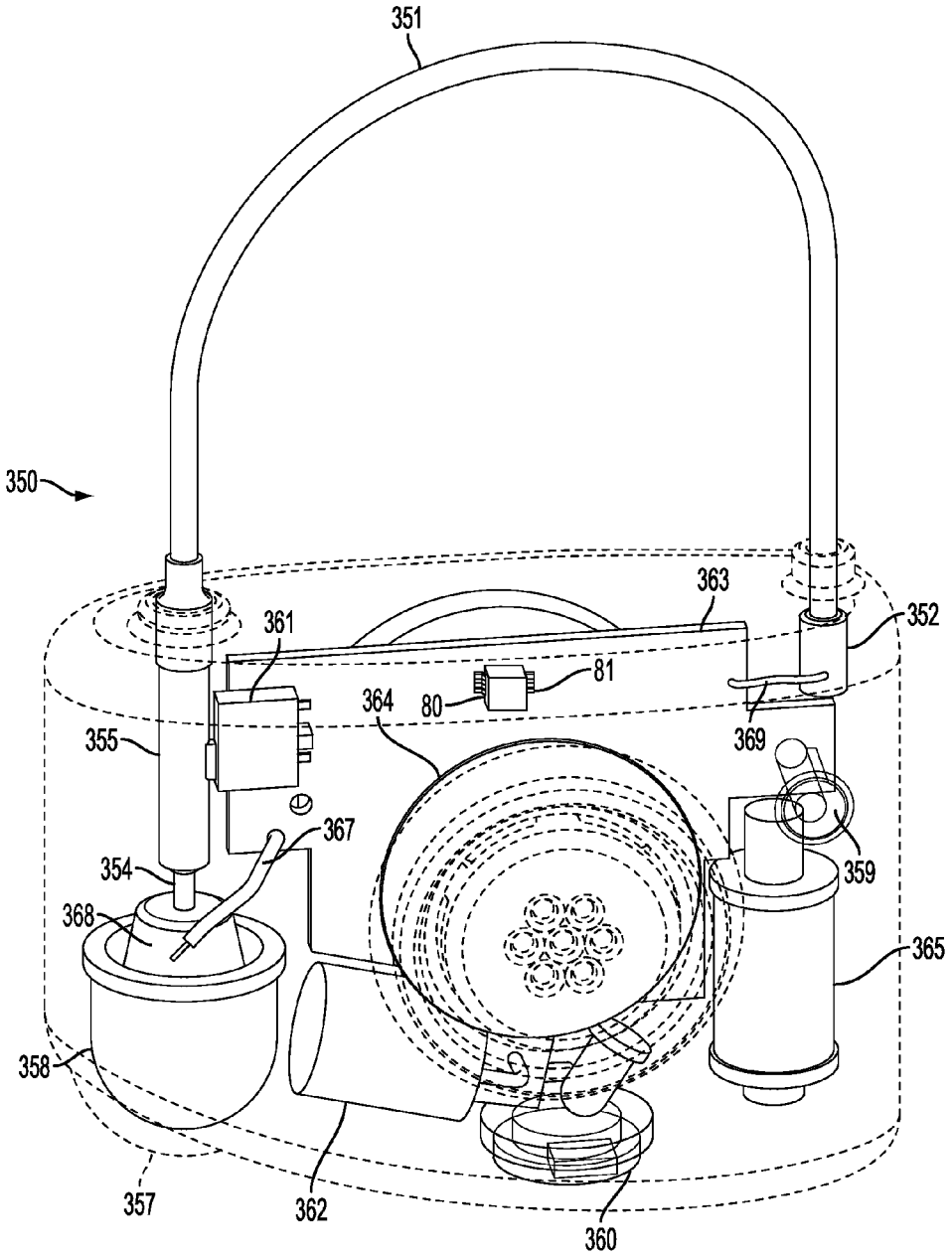
FIG. 3 is a perspective view of a lanyard tag with the outer shell made transparent.

The embodiment of an EAS tag shown in FIG. 1 attaches to an item to be protected by hinging around a feature on the item to be protected and latching in position. Other embodiments of tags may use other attaching mechanisms to attach the EAS tag to an object to be protected. FIGS. 2 and 3 show embodiments of such EAS tags. The particular attaching mechanism used influences the methods employed for arming the EAS tag as it is installed on an object to be protected.

FIG. 2 is an exploded perspective view of an EAS tag 300, and shows several of the elements internal to tag 300. In the embodiment of an EAS tag shown in FIG. 2, tag 300 is attached to an object to be protected by tack 301. Shaft 302 of tack 301 passes through an object to be protected and into an aperture in clutch housing 307, where it is releasably retained. The object to be protected may be an article of clothing, etc. Tag 300 carries active electronic article surveillance (EAS) electronics, a battery to power the active electronics, and in some embodiments, a passive EAS element, as well as tamper detection sensors.

At the left end of tag 300 are elements associated with attaching tag 300 to an item to be protected, such as clutch housing 307, shaft switch 316, and tack 301. Shaft switch 316 is held in place by brackets 306. In the center and to the right of tag 300 are electronics elements for active security functions of tag 300. Located within tag 300, and shown attached to circuit board 312, are light emitting diode 310, battery 311, magnetometer 80, and audible alarm generator 313. Normally attached to the bottom of circuit board 312, in this embodiment of tag 300, but shown outside of tag 300 in FIG. 2 are microprocessor 317, motion sensor 318, radio frequency receiving and transmitting circuitry 319. In some embodiments, receiving and transmitting circuitry function as a transceiver. Microprocessor 317 is capable of storing machine readable instructions and executing those machine readable instructions based on inputs from the other elements in tag 300. In addition to these powered electronics, passive EAS element 314 is also shown in FIG. 2. Dome 305 at the top in FIG. 2 provides a visual cue for where to apply a magnet to release clutch 307. Vent 315 at the top of FIG. 2 allows sounds generated by audible alarm generator 313.

FIG. 3 is a perspective view of lanyard tag 350 with the outer shell made transparent. As may be seen in FIG. 3, lanyard tag 350 is capable of carrying the same electronics as tag 300 of FIG. 3. Visible in FIG. 3 are circuit board 363, battery 362, audible alarm generator 364, magnetometer 80, and passive EAS element 365. Not visible in FIG. 3 is a microprocessor, motion detector, and radio frequency receiver which are mounted on the opposite side of circuit board 363 in the embodiment shown in FIG. 3.

Although lanyard tag 350 shown in FIG. 3 operates in the asset protection system essentially the same as tags 10 and 300 of FIGS. 1 and 2, lanyard tag 350 attaches to an object to be protected with a different mechanism and therefore the tamper indicators in lanyard tag 350 are different. Lanyard tag 351 attaches to an object to be protected by encircling some portion of that object with a lanyard. Lanyard 351 has a permanently anchored end 352 and a removable end with retention pin 354, and, in some embodiments, along its length, some portion of lanyard 351 is made of an electrically conductive material. In particular, many embodiments of lanyard tag 350 will have a lanyard 351 having its core made of an electrically conductive cable. The removable end of lanyard 351 has a retention pin 354 section and a contact cylinder 355 section. To retain lanyard tag 350 on an article, lanyard 351 is passed through the article and retention pin 354 is inserted into retention mechanism 368 located in lanyard tag 350. Alternatively to passing lanyard 351 through an article, lanyard 351 may be passed around some location on an article where it may not be easily removed. In one embodiment of tag 350, the mechanism that retains retention pin 354 in aperture 356 is a ball clutch which can be made to release retention pin 354 by application of a magnet to clutch cone 357 visible on the bottom of lanyard tag 350 in FIG. 3. In some embodiments, the clutch within housing 358, visible in FIG. 3, has at least some magnetically attractable material in it, and is the element acted upon by the magnet to release retention pin 354.

In addition to alarming when it is being moved and no system signal is detected, lanyard tag 350 is capable of self alarming upon the occurrence of any one of several events. One event that can trigger self alarming by tag 350 is physical tampering with the tag. A common attack used against lanyard type tags is the cutting of the lanyard. Referring to FIG. 3, once coupler end 353 of lanyard 351 is inserted through aperture 356 and into retention mechanism 368, two tamper detection circuits are completed. A first tamper detection circuit includes clutch wire 367, retention mechanism 368, retention pin 354, contact cylinder 355, and switch 361 and is completed on circuit board 363 (microprocessor, etc.). This first tamper detection circuit establishes that retention pin 354 of lanyard 351 has been inserted. A second tamper detection circuit includes lanyard wire 369, lanyard 351 and can be completed by two possible routes. One completion route includes contact cylinder 355, switch 361, and circuit board 363 (microprocessor, etc.). Another completion route includes retention pin 354, retention mechanism 368, clutch wire 367 and circuit board 363 (microprocessor, etc.). This second tamper detection circuit monitors the integrity of lanyard 351. If lanyard 351 is cut, the first tamper detection circuit is still completed, while the second detection circuit is opened. When tag 350 detects that lanyard 351 has been cut, it self alarms with an audible alarm generator generating an audible sound. Some embodiments of tag 350 will self alarm when the body of tag 350 is opened or otherwise compromised. In this case the self alarm may be triggered by the displacement of circuit board 363 or other means.

In the following description, the EAS tag element is generally referred to as EAS tag 10, but other EAS tags with different attaching mechanisms could serve in the save facshion as EAS tag 10. Once EAS tag 10 is installed to an object and armed, EAS tag 10 begins to operate according to machine readable instructions in microprocessor 72 and any other logic elements present in tag 10. Magnetometer 80 measures the magnetic fields about tag 10 and periodically sends a digital image, or snapshot, of the ambient magnetic fields to microprocessor 72 for storage and for later comparison.

Presumably, after tag 10 is installed on an object to be protected, it is placed in a location where it remains, waiting to be sold or otherwise disposed. Motion sensor 79 monitors for motion and is in communication microprocessor 72. After a preprogrammed period of stasis, microprocessor 72 receives from magnetometer 80 a final digital snapshot of the magnetic fields surrounding tag 10 and stores it. Then, with the exception of microprocessor 72 and motion sensor 79, the electronics of tag 10 go dormant. Motion sensor 79 monitors for movement of tag 10 and microprocessor 72 is in communication with motion sensor 79 to receive notice that tag 10 is being moved.

When motion sensor 79 detects that tag 10 is in motion, the other electronic elements of tag 10 in addition to motion sensor 79 and microprocessor 72 become active. Magnetometer 80 measures the magnetic fields around it and delivers a digital snapshot to microprocessor 72 for comparison to the snapshot stored before tag 10 went still. If the snapshots diverge beyond a preset percentage, microprocessor 72 may determine an alarm condition exists and generate an alarm. This alarm may take the form of an audible alarm generated by audible alarm generator 74.

If the compared snapshots fall within a normal percentage of error for deviation, the electronics remain active and magnetometer 80 continues to measure the magnetic fields of the environment of tag 10. These measurements are sent to microprocessor 72 for analysis. This continues while motion sensor 79 and the programming of tag 10 determine tag 10 to be in motion. If the readings of magnetometer 80 precipitously decrease, this would be interpreted by the electronics of tag 10 that tag 10 has been placed in a metallic foil bag to impede the functioning of tag 10 and the broader EAS system. This would result in tag 10 determining an alarm condition. The electronics of tag 10 would then generate alarms. A primary alarm would be an audible alarm generated by audible alarm generator 74.

Other alarms such as optical alarms generated by light emitting diode 76 and radio frequency (or AMF) alarms broadcast by radio frequency circuitry 78 could also be generated. These latter types of alarms would be less effective from within a foil bag, but could be generated nevertheless in case the foil bag is opened to disable the audible alarm or for other reasons. Once the foil bag is opened, the optical alarm and radio frequency (or AMF) alarm would be able to immediately communicate with the broader EAS system and create a general system alarm.

If an item with EAS tag 10 is again set down for a predetermined period, tag 10 would again go idle and function at the lower level of activity deemed appropriate. The capability of moving between levels of activity when tag 10 is being moved and when it is still, allows tag 10 to conserve the energy of its onboard power supply, typically a battery 77. Elements such as audible alarm generator 74, infrared communication port 75, light emitting diode 76, radio frequency circuitry 78, and magnetometer 80 can be dormant while tag 10 is still, or periodically activated at specific times.

Figure 4:
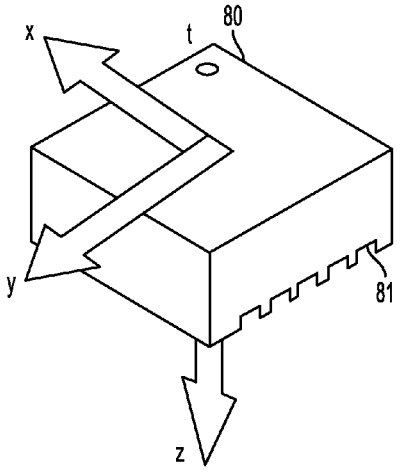
FIG. 4 is a perspective view of a magnetometer separate from its mounting.

FIG. 4 is a perspective view of magnetometer 80 separate from its mounting. Magnetometer 80 has a series of pins 81 for mounting to and communicating with circuit board 70. Magnetometer 80 is capable of measuring the magnetic fields about it in three dimensions and communicating this information digitally to other elements. One commercial example of magnetometer 80 is MAG3110 Three-Axis, Digital Magnetometer by Freescale Semiconductor, Inc.

The machine readable instructions in microprocessor 70 can be loaded and edited by external devices of the broader EAS system. These devices can communicate with tag 10 via several methods such as wireless communication including optical, i.e. infrared, communication or radio frequency communication or some tags 10 may be communicated with by contacting exposed contacts on tag 10. EAS tag 10 may have a programmable passcode among its instructions which can be changed either by external devices or internal algorithms.

EAS tag 10 may have a programmable passcode among its instructions which can be changed either by external devices or internal algorithms. EAS tag 10 can store a security passcode. When an external device interacts with tag 10, it can transmit the passcode to tag 10 which compares to a value stored by tag 10. If the passcode transmitted by the external device to tag 10 and the stored value match, tag 10 will allow the communicated instructions, such as a disarming instruction, to be executed. Once tag 10 disarms and it may be released from the item to which it is attached without an alarm being generated. If the system employs a unique passcode for each tag 10, then the system must first receive a unique identifier associated with a given tag 10. With that information, the system can determine the correct passcode and transmit it to tag 10 to disarm tag 10. An incorrect passcode will not cause tag 10 to disarm and subsequent removal of tag 10 will cause an alarm condition.

Figure 5:
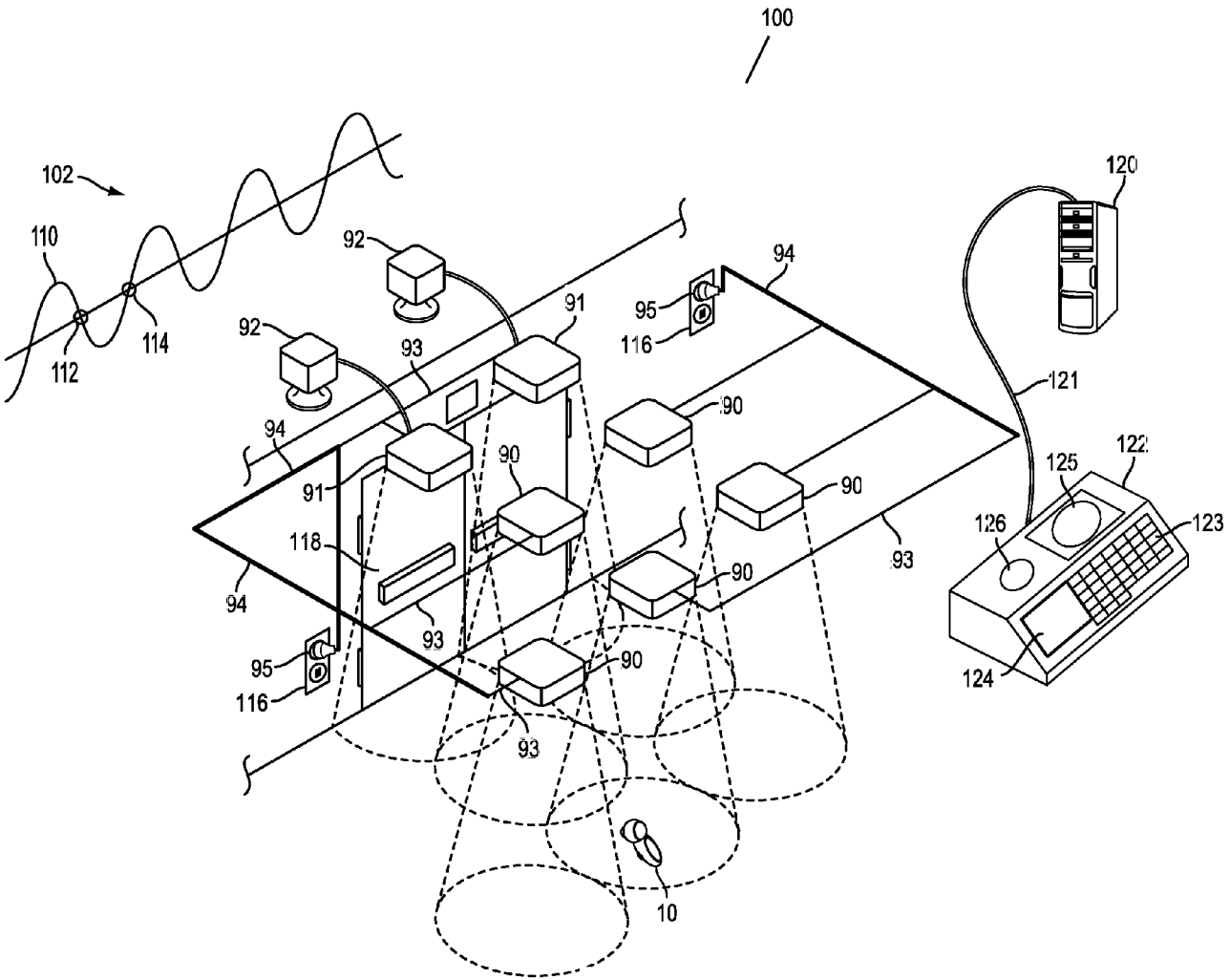
FIG. 5 is an overall view of an electronic article surveillance system.

FIG. 5 is an overall view of an electronic article surveillance system 100. A plurality of signal, or field, transmission units 90 and 91 are used by the electronic article surveillance system 100 to create and shape a monitoring field in a protected area. In one embodiment, each transmission unit 90 and 91 has a programmable controller, memory, signal transmitting and receiving means, and standard power cords 93 for power. Other embodiments may have an onboard power transformer to change the voltage of the power received through power cord 93 to accommodate onboard electronics. Computer 120 performs database functions and other data intensive functions and connects to controller 122 with cable 121. Controller 122 provides a means of interacting with tags 10 as well as performing some data entry functions.

Each transmission unit 90 and 91 is independently capable of radiating an area with a radio frequency field, although, as discussed in more detail below, transmission units 90 and 91 may perform different functions. In some embodiments of electronic article surveillance system 100, the transmission units may operate as signal transmission units 90 and interference transmission units 91. In at least one embodiment the transmission units 90 and 91 are mounted overhead with the individual fields generated by each transmission unit expanding as it reaches down into the occupied levels of the monitored area. This allows the entire target area to be covered without intrusive installations at the level where persons and objects will be located. A sample tag 10 is shown in FIG. 5. As discussed above, tags 10 are releasably attached to items to be protected and generate alarms under particular conditions.

Signal transmission units 90, 91 transmit a field at a known frequency and, in at least one embodiment, are powered by standard wall outlet power as shown in FIG. 5. Power cords 93 may be connected and bussed together through conduits 94 to plugs 95 at wall outlets 116, or they may be dispersed enough to rely upon their own power cords 93 to plug into wall outlets. As illustrated in FIG. 5 at 102, the mains power supply for electronic article surveillance system 100 comprises a sinusoidal voltage wave 110 having characteristic points in the wave such as zero crossing points, two of which are indicated at 112 and 114. Zero crossing point 112 occurs on a decreasing slope of sinusoidal voltage wave 110 and zero crossing point 114 occurs at an increasing slope of sinusoidal voltage wave 110. There are other characteristic points such as maximum, minimums, etc. Signal transmission units 90 and interference transmission units 91 are capable of detecting particular points, such as zero crossing points 112 and 114, in sinusoidal voltage wave 110 and using the detected points as references to synchronize with each other. By synchronizing with each other, transmission units 90, 91, can continuously monitor an area by generating intermittent fields which are continuously turned on and off in synchrony. When transmission units 90, 91 are off, interference transmission units 91 can monitor for signals from tags at specified frequencies. Synchronization prevents different transmission units from contaminating the monitoring periods of other transmission units. While in some embodiments of electronic article surveillance system 100, signal transmission units 90 may be able to monitor for signals from tags 10, in most embodiments of electronic article surveillance system 100, only interference transmission units 91 will monitor for tags signals, since interference transmission units 91 will be located at exits to shape the monitoring field.

In at least one embodiment, the signal field generated by signal transmission units 90 has a validation code modulated onto it. An EAS tag operating as part of the electronic article surveillance system, such as tag 10 shown in FIG. 5, can detect the signal field generated by signal transmission units 90 to confirm that it is presently in the protected area and also decipher the validation code from the signal field. A tag 10 failing to detect the signal field when expected, and decipher a validation code when a validation code is being used, will determine an alarm condition and generate alarms. A tag may fail to detect the signal field because it has been removed from the monitored area or because it is being blocked from receiving the signal field, for example, by being wrapped in metal foil or being placed in a foil lined bag.

Referring again to FIG. 5, exit 118 consists of two doors leading from the monitored area. Above exit 118 are two interference transmission units 91 that combine to broadcast an interference field in front of exit 118. This interference field is at a frequency that is within the receiving bandwidth of tag 10 and the interference field does not have the validation code. In the embodiment shown in FIG. 5, interference transmission units 91 are connected to audible alarm generators 92 which generate audible alarms when energized by interference transmission units 91.

Referring still to FIG. 5, controller 122 is connected to computer 120 by cable 121. The embodiment of controller 122 shown in FIG. 5 has a keypad 123 for command and data entry, a display screen 124, a communication pad 125 for radio frequency communication with tag 10, and a detacher 126 for allowing tags 30 to be detached from objects. In embodiments of electronic article surveillance system 100 where multiple transmission units 90, 91 are present, computer 120 may associate tag 10 with its nearest transmission unit 90, 91.

Some embodiments of the EAS system may employ time base algorithms to periodically change passcodes. In those cases, each tag will also have an onboard clock. At specified intervals, the passcode is changed according to the algorithm. If each tag has a unique passcode, the system, which will also have at least one clock, can track the changing passcodes for each tag based on knowing a tags passcode at some given initial time. Other embodiments of the system, may use a single passcode system wide. In this embodiment, each element has a clock and the same passcode at any given time. At specified intervals, each element updates its own passcode according to the algorithm to a new passcode which is the same for each element in the system.

It is to be understood that the embodiments and claims are not limited in application to the details of construction and arrangement of the components set forth in the description and illustrated in the drawings. Rather, the description and the drawings provide examples of the embodiments envisioned, but the claims are not limited to any particular embodiment or a preferred embodiment disclosed and/or identified in the specification. The drawing figures are for illustrative purposes only, and merely provide practical examples of the invention disclosed herein. Therefore, the drawing figures should not be viewed as restricting the scope of the claims to what is depicted.

The embodiments and claims disclosed herein are further capable of other embodiments and of being practiced and carried out in various ways, including various combinations and sub-combinations of the features described above but that may not have been explicitly disclosed in specific combinations and sub-combinations. Accordingly, those skilled in the art will appreciate that the conception upon which the embodiments and claims are based may be readily utilized as a basis for the design of other structures, methods, and systems. In addition, it is to be understood that the phraseology and terminology employed herein are for the purposes of description and should not be regarded as limiting the claims.

While, for explanatory reasons, retail applications have been discussed in more detail, other embodiments of the invention may be used to track persons. For example, embodiments of the invention may be used to track newborns at hospitals, elderly people at assisted living facilities, and inmates of corrections facilities where it is desirable to monitor the presence of a person within an area. In those cases, the term "item" would apply to a person wearing an embodiment of a tag of the present invention. Additionally, any operation that needs to maintain control of assets within a given area, such as an R&D group, would benefit from an application of an embodiment of the invention.

I claim:

1. An electronic article surveillance device comprising:

a housing, said housing enclosing an electronics package;

an attaching element for releasably attaching said housing to an object to be protected;

said electronics package comprising a microprocessor having machine readable instructions for executing electronic article surveillance, a motion detector, a magnetometer, wireless communication elements, and a power supply powering the other elements of said electronic package; wherein, when the device is attached to an object to be protected and armed, said magnetometer records an initial reading of the ambient magnetic field around the device and transmits a digital representation of the initial reading to said microprocessor, said microprocessor storing said initial reading, said magnetometer thereafter periodically recording the ambient magnetic environment around the device and transmitting a digital representation of the current ambient magnetic environment to said microprocessor, said microprocessor comparing the digital representation of the current ambient magnetic environment with at least one previously stored digital representation of the ambient magnetic environment to determine whether an alarm condition exists.

2. The electronic article surveillance device of claim 1, wherein:

when said microprocessor determines an alarm condition, said microprocessor transmits an alarm signal via said wireless communication elements.

3. The electronic article surveillance device of claim 1, wherein:

said wireless communication elements comprise radio frequency communication circuitry.

4. The electronic article surveillance device of claim 1, wherein:

said wireless communication elements comprise an optical communication port and light emitting diode.

5. The electronic article surveillance device of claim 1, wherein:

said electronics package further comprises a sound generator; wherein, when said microprocessor determines an alarm condition, said microprocessor generates an audible alarm signal via said sound generator.

6. The electronic article surveillance device of claim 1, wherein:

said microprocessor monitors said motion detector, and when said motion detector does not detect motion in the device for a predetermined length of time, said microprocessor switches said electronics package to a minimal operating state in which only said microprocessor and motion detector operate and said microprocessor monitors said motion detector for motion of said device, said microprocessor storing a digital representation of the ambient magnetic environment before switching to said minimal operating state.

7. The electronic article surveillance device of claim 6, wherein:

when said electronics package is in said minimal operating state, and said motion detector detects motion in the device and communicates that to said microprocessor, said microprocessor activates the remaining components in said electronics package, receives a digital representation of the current ambient magnetic environment and compares it to a previous digital representation of the ambient magnetic environment to determine if an alarm condition exists.

8. The electronic article surveillance device of claim 7, wherein:

when said microprocessor activates the remaining components in said electronics package, said wireless communication elements attempt to establish communications with an external device.

9. The electronic article surveillance device of claim 1, wherein:

said electronics package further comprises a switch for detecting whether the housing is attached to an object to be protected.

10. The electronic article surveillance device of claim 1, wherein:

the operation of said electronics package can be altered by communication from an external device.

11. The electronic article surveillance device of claim 10, wherein:

said microprocessor stores a passcode which must be transmitted by the external device to verify the authority of the external device.

12. An electronic article surveillance system comprising:

at least one radio frequency transmitting and receiving unit monitoring a controlled area, said unit comprising a processor, radio frequency communication circuits, and a power source;

an electronic article surveillance device, said device comprising a housing, said housing enclosing an electronics package;

an attaching element for releasably attaching said housing to an object to be monitored in the controlled area;

said electronics package comprising a microprocessor having machine readable instructions for executing electronic article surveillance, a motion detector, a magnetometer, wireless communication elements comprising radio frequency communication circuitry, and a power supply powering the other elements of said electronic package; wherein, when said device is attached to an object to be protected and armed, said magnetometer records an initial reading of the ambient magnetic field around said device and transmits a digital representation of the initial reading to said microprocessor, said microprocessor storing said initial reading, said magnetometer thereafter periodically recording the ambient magnetic environment around said device and transmitting a digital representation of the current ambient magnetic environment to said microprocessor, said microprocessor comparing the digital representation of the current ambient magnetic environment with at least one previously stored digital representation of the ambient magnetic environment to determine whether an alarm condition exists wherein, said at least one unit and said device communicate via radio frequency communication.

13. The electronic article surveillance system of claim 12, further comprising:

at least one controller, said controller comprising a communication pad, and a keypad, said communication pad being capable of communication with said device via radio frequency communications.

14. The electronic article surveillance system of claim 12, wherein:

said at least one unit periodically transmits a radio frequency signal.

15. The electronic article surveillance system of claim 14, wherein:

said power supply of said at least one unit is standard AC power, and said at least one unit times the transmission of said radio frequency signal off of the power mains.

16. The electronic article surveillance system of claim 12, wherein:

when said microprocessor determines an alarm condition, said microprocessor transmits an alarm signal via said wireless communication elements.

17. The electronic article surveillance system of claim 12, wherein:

said electronics package further comprises a sound generator; wherein, when said microprocessor determines an alarm condition, said microprocessor generates an audible alarm signal via said sound generator.

18. The electronic article surveillance system of claim 12, wherein:

said microprocessor monitors said motion detector, and when said motion detector does not detect motion in said device for a predetermined length of time, said microprocessor switches said electronics package to a minimal operating state in which only said microprocessor and motion detector operate and said microprocessor monitors said motion detector for motion of said device, said microprocessor storing a digital representation of the ambient magnetic environment before switching to said minimal operating state.

19. The electronic article surveillance system of claim 18, wherein:

when said electronics package is in said minimal operating state, and said motion detector detects motion in said device and communicates that to said microprocessor, said microprocessor activates the remaining components in said electronics package, receives a digital representation of the current ambient magnetic environment and compares it to a previous digital representation of the ambient magnetic environment to determine if an alarm condition exists.

20. The electronic article surveillance system of claim 19, wherein:

when said microprocessor activates the remaining components in said electronics package, said wireless communication elements attempt to establish communications with an external device.

* * * * *